United States Patent [19]

Gerndt

[11] Patent Number: 4,819,397

[45] Date of Patent: Apr. 11, 1989

[54] WALL PANEL

[75] Inventor: Robert J. Gerndt, Roswell, Ga.

[73] Assignee: Kimberly-Clark Corporation, Neenah, Wis.

[21] Appl. No.: 98,256

[22] Filed: Sep. 18, 1987

[51] Int. Cl.[4] ..... E09B 2/00

[52] U.S. Cl. ..... 52/406; 52/407

[58] Field of Search ..... 52/404, 406, 407, 222, 52/273

[56] References Cited

U.S. PATENT DOCUMENTS

| | | | |
|---|---|---|---|
| 2,094,635 | 10/1937 | Brooks | 57/407 |
| 2,409,951 | 10/1946 | Nootens | 52/404 |
| 3,080,022 | 3/1963 | Mote | 57/407 |
| 3,705,063 | 12/1972 | Stumpf | 156/72 |
| 4,696,138 | 9/1987 | Bullock | 57/407 |

*Primary Examiner*—David A. Scherbel
*Assistant Examiner*—Creighton Smith
*Attorney, Agent, or Firm*—William D. Herrick

[57] ABSTRACT

There is disclosed a wall panel and wall paneling system which panels include a light weight polystyrene tray having an compartment. Within the compartment is installed a insulative, resilient insert. A fabric facing or web is loosely stretched across the opening of the tray's compartment to enclose the insert within the compartment, and the fabric is glued to the walls of the tray. When the wall panel is installed, by gluing it to the existing walls, molding strips engage the side walls of the tray to hold adjacent panels together, to stretch the fabric facing more tightly across the opening of the compartment, and to expose the molding strips and side walls as uniformly spaced vertical battens.

9 Claims, 3 Drawing Sheets

WALL PANEL

BACKGROUND OF THE INVENTION

This invention relates generally to wall paneling and more particularly concerns a fabric covered wall panel which is unique in appearance, light in weight, has good sound and thermal insulation properties, and is easily installed with simple tools and modest skill.

In conventional residential construction, the walls of the basement are frequently constructed of cinder block or poured concrete. When such basement space is finished, it is usually desirable to install a wall system over the concrete walls of the foundation. Typically, furring strips are required along the wall on which to nail wood paneling. In some cases conventional stud walls may be constructed in front of the concrete foundation walls in order to provide both a structure on which to mount the drywall or wood paneling and a space in which to install insulation. Whether drywall or paneling is used, installation of either generally requires skilled or semi-skilled labor to insure the requisite degree of finish.

SUMMARY OF THE INVENTION

It is therefore an object of the present invention to provide a wall panel and a wall paneling system which can be installed directly over existing walls such as concrete basement walls without the necessity of furring strips or stud walls.

It is likewise an object of the present invention to provide a unique fabric covered wall panel which has good thermal and sound insulation and is light in weight.

It is also an object of the present invention to provide a wall panel and wall paneling system which can be installed with simple tools and by persons of modest skill as for example a do-it-yourself home owner.

The foregoing objectives are achieved by a lightweight wall panel which consists of a lightweight box frame or tray having a back wall, a top wall, a bottom wall, and two side walls which form a compartment with an opening on the front. An insulative, resilient insert is located within the compartment of the tray, and the opening is covered by fabric which is glued to the top, bottom, and side walls of the tray. The panels may be provided in any size, but a common size may be 8 ft. long and 1 or 2 ft. wide so that the panels can be mounted vertically by simply gluing the panels to the concrete wall. Once the panels have been glued to the concrete wall side by side, they are joined by means of a U-shaped molding strip which overlays and engages adjacent side walls of adjacent panels to hold them together and provide an additional decorative touch. Because the fabric facing web is stretched loosely across the distance between the side walls before installation, the molding strip when installed engages the fabric and tightens it across the resilient insert thereby providing a convex fabric surface between the side walls. The repeated pattern of molding strip- -convex web- -molding strip produces a unique and pleasing appearance.

Other objects and advantages of the present invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
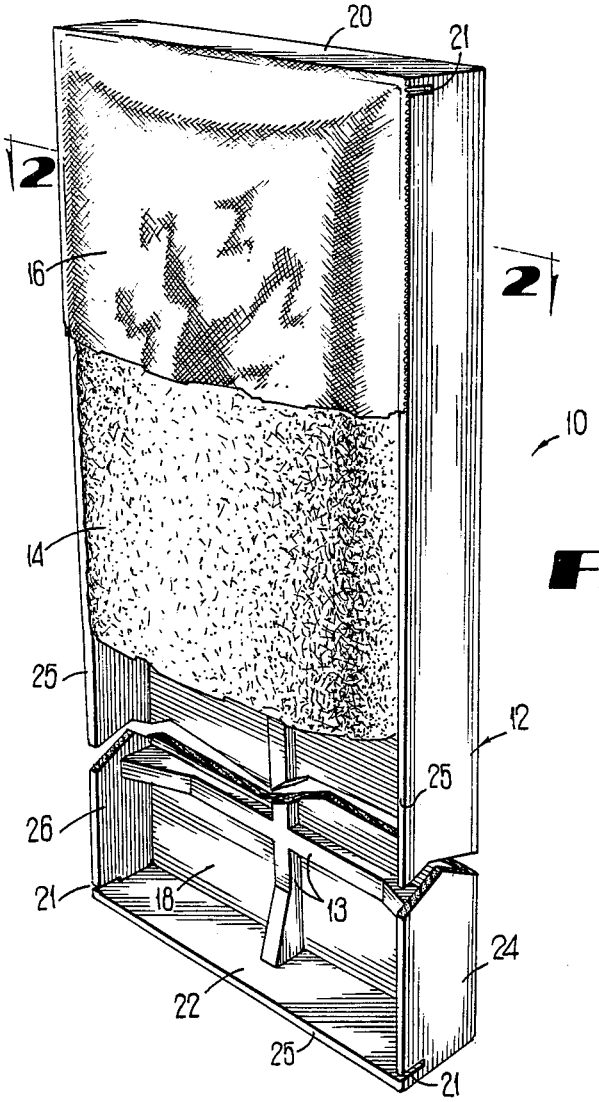
FIG. 1 is a perspective view of the wall panel of the present invention.
Figure 2:
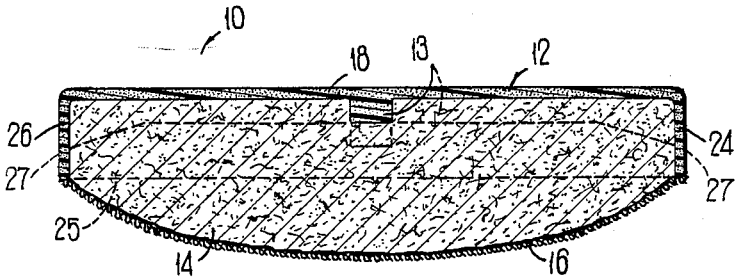
FIG. 2 is a section view as seen along line 2—2 of FIG. 1.

Turning to FIGS. 1 and 2, there is shown a wall panel 10 comprising a box frame or tray 12, an insulative, resilient insert 14, and a flexible decorative facing fabric 16.

The tray 12 includes back wall 18, top side wall 20, bottom side wall 22, right side wall 24, left side wall 26, and integral gussets 13 which serve to stiffen and strengthen the tray in general and in particular the side walls. The tray 12 is light in weight weighing from 3 to 12 lbs. per cubic ft. ($lb/ft^3$) and preferably about 4 $lb/ft^3$. For a panel 8 ft. long by 1 ft. wide, the tray 12 should weight between 1 and 5 lbs. Preferably, the tray 12 is molded from foamed plastic such as expanded polystyrene foam. High strength corrugated board or compressed fiberglass may also be used for constructing the tray. The walls of the tray may range from 0.2 inch to 0.75 inch in thickness. The thickness of the side walls 20, 22, 24, and 26 and the back wall 18 should be equal in order to facilitate installation around door and window casings.

The insulative resilient insert 14 may be any resilient batt material such as fiberglass insulation. In order to provide sound and thermal insulation, such insulation generally has a density of about 0.75 $lbs/ft^3$ when used in connection with residential installations and from 1 $lb/ft^3$ to 2 $lb/ft^3$ when used in connection with wall panels for commercial installation.

The fabric 16 can be any decorative fabric or web and can be chosen primarily for its esthetic value. In order to provide the requisite strength, the fabric generally should have a basis weight of greater than 2 ounces per square yard ($oz/yd^2$). The web 16 is normally attached to the box frame 12 by means of gluing the fabric to the top side wall 20, the bottom side wall 22, the right side wall 24, and the left side wall 26 at either the front edges 25, or the outward surfaces 27 of the sides, or both. As can be seen from FIG. 2, the fabric 16 is stretched loosely across the opening between side walls 24 and 26.

Figure 3:
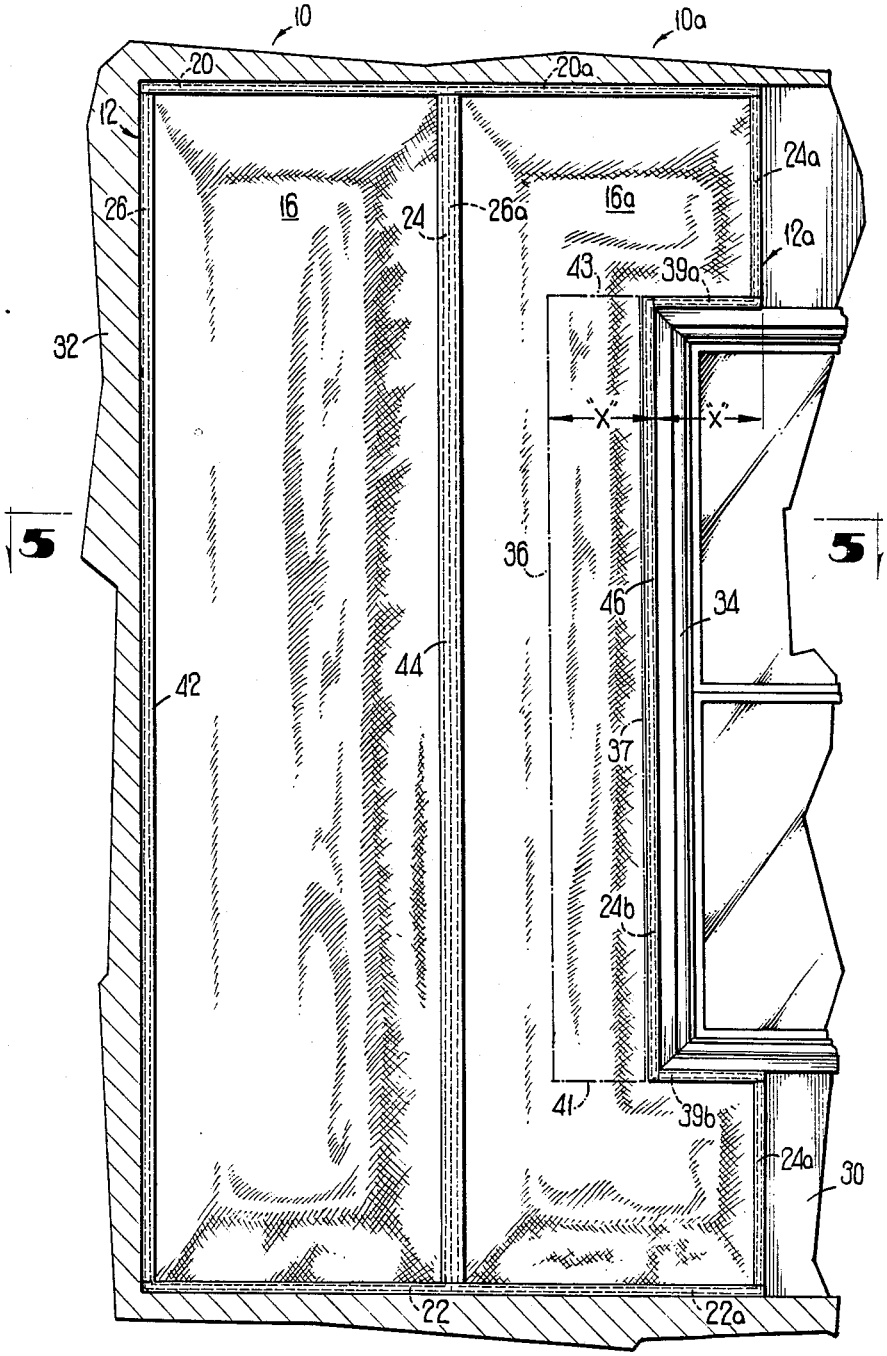
FIG. 3 is a front elevation view showing two panels installed side by side.
Figure 4:
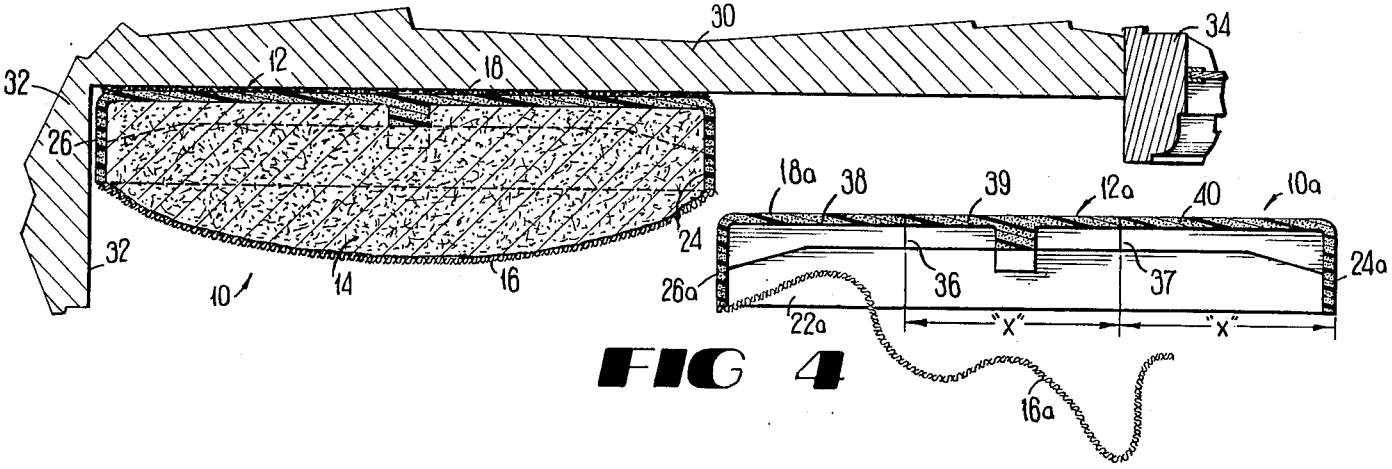
FIG. 4 is a section view showing two wall panels of the present invention shown at an intermediate stage of installation.
Figure 5:
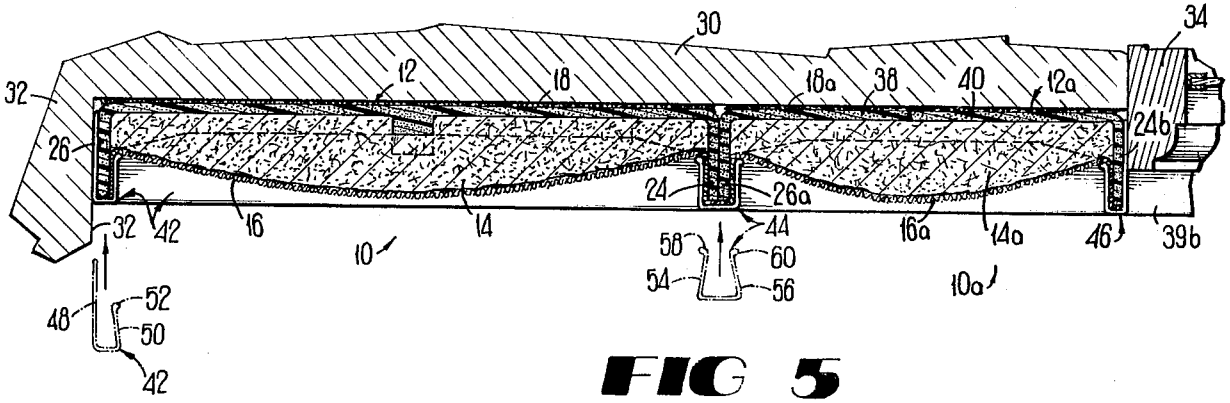
FIG. 5 is a cross-section view showing two wall panels of the present invention completely installed as seen along line 5—5 of FIG. 3.

Turning to FIGS. 3, 4 and 5 there is shown an installation of two wall panels 10 and **10*a* of the present invention. Particularly, the wall panels 10 and 10*a* are installed against an existing wall 30 between a side wall 32 and a window casing 34. The distance between the side wall 32 and the window casing 34 is less than the combined width of the panels 10 and 10***a*. Therefore, it is necessary for the installer to accommodate the narrow width by cutting and modifying panel 10*a* as will be described in greater detail. The panels 10 and 10a in FIGS. 3, 4 and 5 are attached to the wall 30 by gluing the back wall 18 of the panel wall 10 directly to the existing wall 30. Any number of commonly available adhesives will provide good bonding between the polystyrene tray 12 and the existing wall 30. Once the panel 10 has been glued in place, the next panel 10*a* is installed by butting its left side wall 26*a* against the right side wall 24 of panel 10. In order to accommodate the width between the right side wall 24 of panel 10 and the window casing 34, it is necessary to first shorten the width of the panel 10*a*. In order to custom fit the panel 10*a* to the space available, the fabric facing 16*a* is first pulled loose from the side walls 20*a*, 22*a*, and 24*a* and the insert 14*a* is removed. The polystyrene tray 12*a* is then cut by means of a knife along its back wall 18*a* along lines 36, 37, 41, and 43 (FIG. 3) to form sections 38, 39, and 40. As can be seen in FIG. 4, the panel 10*a* extends beyond the window frame 34 by a distance "X". The panel 10*a* is cut so that the length of section 39 is "X". Sections 38 and 40 include the side walls 26*a* and 24*a* respectively. Section 39 is discarded and sections 38 and 40 are fastened to the existing wall 30 with adhesive to reconstruct the tray 12*a* with a continuous back wall and side walls 26*a* and 24*a*. Referring to FIG. 3, a top wall 39*a* and bottom wall 39*b* can now be cut out of the unused previously discarded section of the back wall 39 by cutting to proper size and turning on edge. Because the thickness of the back wall and side walls are equal, a contiguous side wall can be constructed around the window frame. The insert 14a is then cut to size and replaced inside the compartment formed by the side walls and end walls. The fabric 16a is then loosely stretched and reglued to side walls 24*a*, 24*b*, 20*a* and 22*a*.

The installation of the panels 10 and 10*a* is completed as shown in FIG. 5 by attaching U-shaped molding strips 42, 44, and 46. The molding strips engage the side walls and fabric and hold the panels 10 and 10*a* together to provide a finished edge, and to stretch the fabric more tightly across the opening between the side walls. Particularly, U-shaped molding strip 42 has a long leg 48 which slips between the wall 32 and the side wall 26 of panel 10. The molding strip 42 also has a short leg 50 with a curved end 52 which engages the fabric 16 and holds it against the side wall 26. Slots 21 (FIG. 1) in the side walls at the top and bottom of each tray allow the continuous application of molding strips such as 42 along the top and bottom of adjacent trays. The molding strip 44, on the other hand, has two short legs 54 and 56 with curved ends 58 and 60 respectively. The molding strip 44 slips over the side walls 24 of panel 10 and 26*a* of panel 10*a* to hold the side walls together. In addition, the molding strip 44 engages the fabric 16 and 16*a* to hold the fabric against the respective side walls and thereby stretch the fabric across the opening between the side walls.

I claim:

1. A wall panel comprising:

(a) a box frame having a back wall and connected side walls which together form a compartment with an opening;

(b) an insulative resilient insert within the compartment;

(c) a flexible, decorative facing fabric web directly engaging the side walls and extending across the opening to enclose the compartment; and (d) means for engaging said facing fabric web to tighten it across said resilient insert providing a convex fabric surface.

2. The wall panel of claim 1, wherein the facing web is stretched loosely across the opening prior to employing said engaging means.

3. The wall panel of claim 1, wherein the box frame is made of material having a density of between 3 $lb/ft^3$ and 12 $lb/ft^3$.

4. The wall panel of claim 3, wherein the box frame material is selected from the group consisting of fibrous board, expanded plastic, and compressed fiberglass.

5. The wall panel of claim 1, wherein the side walls have a side wall thickness and the back wall has a back wall thickness which thicknesses are equal.

6. A wall panel system comprising:

a. a number of wall panels, each comprising:

i. a box frame having a back wall and connected side walls which together form a compartment with an opening.

ii. an insulative, resilient insert within the compartment; and iii. a flexible decorative facing web directly engaging the side walls and extending loosely across the opening to enclose the compartment; and b. a U-shaped molding for engaging adjacent side walls of panels to hold the panels together and to gather and stretch the facing web over the opening.

7. The panel system of claim 6, wherein the side walls have a side wall thickness and the back wall has a back wall thickness which thicknesses are equal.

8. The panel system of claim 6, wherein the box frame is made of material having a density of between 3 $lb/ft^3$ and 12 $lb/ft^3$.

9. The panel system of claim 8, wherein the box frame material is selected from the group consisting of fibrous board, expanded framed plastic, and compressed fiberglass.

* * * * *